US007306226B2

(12) United States Patent
Gagnon

(10) Patent No.: US 7,306,226 B2
(45) Date of Patent: Dec. 11, 2007

(54) MUSICAL GAME

(76) Inventor: Lise Gagnon, 1495, chemin Saint-Dominique, Les Cèdres, Quebec (CA) J7T 1L1

( * ) Notice: Subject to any disclaimer, the term of this patent is extended or adjusted under 35 U.S.C. 154(b) by 64 days.

(21) Appl. No.: 11/263,902

(22) Filed: Nov. 2, 2005

(65) Prior Publication Data

US 2006/0097449 A1 May 11, 2006

Related U.S. Application Data

(60) Provisional application No. 60/625,959, filed on Nov. 9, 2004.

(51) Int. Cl.
*A63F 3/00* (2006.01)

(52) U.S. Cl. ..... 273/242; 273/259; 273/277

(58) Field of Classification Search ..... 273/242, 273/244, 259, 277
See application file for complete search history.

(56) References Cited

U.S. PATENT DOCUMENTS 1,217,810 A 2/1917 Noel
1,558,083 A 10/1925 Gittens
3,070,371 A * 12/1962 Hearle ..... 273/287
3,750,524 A 8/1973 Lee
3,994,500 A 11/1976 Schow
4,895,374 A * 1/1990 Bowles ..... 273/249
D339,610 S 9/1993 Barriault
5,496,179 A * 3/1996 Hoffman ..... 434/433

* cited by examiner

*Primary Examiner*—Vishu K. Mendiratta
(74) *Attorney, Agent, or Firm*—Equinox Protection Inc.; Franz Bonsang

(57) ABSTRACT

A musical game for facilitating learning of musical concepts has a game board with, for each player, a player set of musical symbols inscribed thereupon. Players draw cards which define tasks which must be completed in order to progress in the game by marking musical symbols, with a marker, in their respective player sets on the game board. The first player to mark each symbol in the players respective set is the winner. Additional cards are also provided to direct movement of tokens, one for each player, on spaces on the game board, inscribed thereupon as a partial piano keyboard. A player may become a conductor by marking instruments inscribed on the board with the markers. A conductor has increased opportunities to mark symbols in the respective player set and thus of winning the game.

31 Claims, 5 Drawing Sheets

MUSICAL GAME

CROSS REFERENCE TO RELATED APPLICATIONS

This application claims priority on U.S. Provisional Application for U.S. Pat. Ser. No. 60/625,959 filed Nov. 9, 2004.

FIELD OF THE INVENTION

The present invention relates to games, and in particular to a musical game that is designed to teach players of the musical game the basic elements of music as well as to provide entertainment to players.

BACKGROUND OF THE INVENTION

Musical games have long been part of the family entertainment game industry. Some have been instructional while others simply exploited the pleasure and enjoyment music provides. These games vary in scope and design to include games that are played with cards, game boards, dice, spinners, etc. or a combination of all of the above. In most cases these games deal with limited aspects of the art and science of music whereas the scope of the musical game of the present invention is much more comprehensive involving the basic elements of music as well as providing a basic understanding of the various musical instruments vis-à-vis their association with the bass and treble clefs. The game also provides an elemental understanding of musical composition and an insight into the art of musical conducting.

Accordingly, there is a need for an improved musical game.

SUMMARY OF THE INVENTION

It is therefore a general object of the present invention to provide an improved, musical game.

An object of the invention is to provide a game with a competitive element that will induce the players to learn the basic elements and concepts of music through the playing of the game. Still another object is to provide a relatively simple game that parents or teachers can use to determine if the players involved are inclined to learning music. Yet another object is to provide a game, which in an extended version, will assist in learning additional elements and concepts relating to music that go beyond the basics.

An advantage of the present invention is that the musical game can be played by children and adults alike having no knowledge of music. Another advantage of the present invention is that the musical game has a game board having spaces on the surface of the board inscribed thereon as a depiction of a partial piano keyboard (4 Octaves) arranged in a substantially circular shape with each white key space identified by its proper note name and including playing instructions and/or game symbols printed on it. In addition black key spaces, which correspond to black keys on a piano keyboard, are represented in their proper position with regard to a piano keyboard and have either the bass or treble clef symbol imprinted alternately on each.

A further advantage of the present invention is that the musical game has a game board playing surface four hexagons (player start positions) spaced equidistant from each other under the white key spaces of keyboard having the note name C inscribed thereon and bearing a series of musical symbols. The musical symbols are rhythm symbols used for depicting duration of musical sound relative to a beat of music in a measure, i.e. note symbols consisting of one whole, two half, four quarter, eight eighth and sixteen sixteenth note symbols.

Yet a further advantage of the present invention is that the musical game has on said the game board playing surface four imprinted rectangles located beneath white key spaces having the note names F and G inscribed thereon and which will have cards pertinent to the game placed thereon, the cards being "note cards", train cards", "question cards" and "score cards".

Another advantage of the present invention is that the musical game has on said game board playing surface eight musical staffs (four bass and four treble) one of each being located on either side of the four hexagons and having imprinted on them octaves corresponding to each note's location on the keyboard in the center of the playing surface.

A further advantage of the present invention is that the musical game has printed on the extreme edges of the playing surface of said game board depictions of twenty different musical instruments (male and female voice included) with their respective treble or bass clef inscribed in proximity thereto. There are also five such instruments which have an additional "return sign" symbol inscribed in proximity thereto.

Another advantage of the present invention is that the musical game has the same version of the game printed on the verso side of the game in a second language (French, Spanish, Japanese, etc.).

Yet another advantage of the present invention is that the musical game has a game board surface which is washable, i.e. erasably markable, as the scoring of individual turns requires the use of at least one marker, such as a wax crayon, which may be water soluble and/or otherwise washable, washable water soluble marking pens, or the like.

A further advantage of the present invention is that the musical game has a plurality of different types of cards to be placed face down in their respective rectangles on the game board surface, these cards being entitled "note card, train card, question card and score card".

A further advantage of the present invention is that the musical game provides the players with game tokens and markers to chart their progress as the game is played. Yet a further advantage of the present invention is that the musical game includes a compact disk which allows verification as correct or incorrect of the performance of any score card measures set out on a given score card during the course of the game.

Another advantage of the present invention is that the musical game provides game instructions and rules in the form of an instruction manual.

According to an aspect of the present invention, there is provided a game for learning musical concepts, and which comprises: a plurality of tokens for use by a plurality of players for playing the game, each player having a respective token; a game board upon which the game is played by the players, the game board having a plurality of spaces inscribed thereupon as white key spaces and black key spaces upon which the tokens can be displaced to indicate respective current positions on the game board for the players, and, for each said player, a respective player set of musical symbols inscribed thereupon, the while key spaces and the black key spaces corresponding, respectively, to respective white keys and respective black keys of a piano keyboard with each white key space having a note name inscribed thereon designating a note associated with the respective white key on the piano keyboard the respective token being displaced by an active player of the players executing a respective turn therefore; a first plurality of cards, each card thereof defining a task requiring knowledge of the musical concepts for completion by at least one player and indicating a designated musical symbol corresponding to at least one musical symbol of the respective player set; and at least one marker for marking, by at least one said player, of the designated musical symbol of the respective player set on the game board when the player successfully completes the task.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
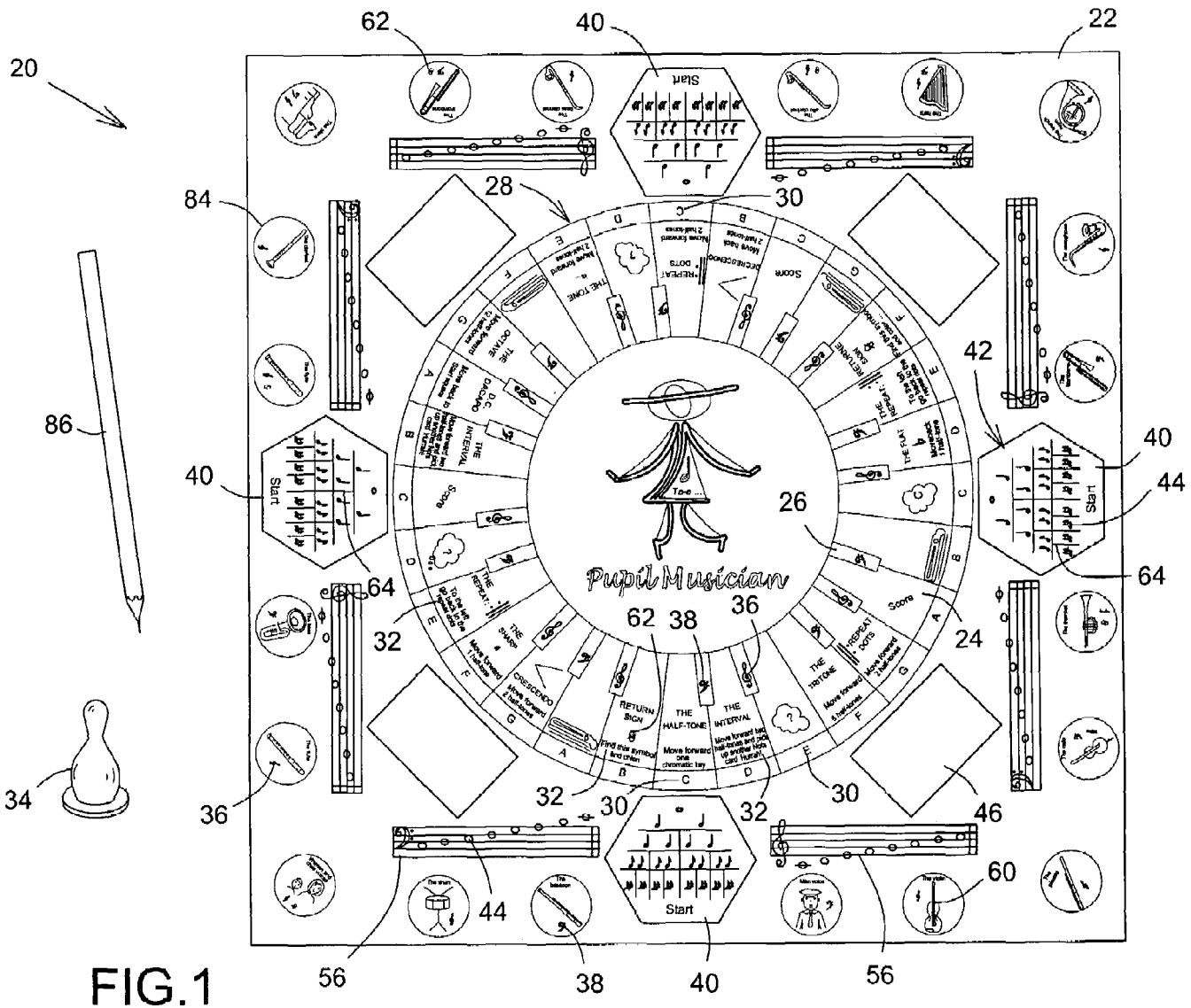
FIG. 1 is a top plan view of a musical game board in accordance with an embodiment of the present invention.

Referring now to the drawings in more detail, FIG. 1 shows a musical game, shown generally as 20, including a game board 22 having at its center a plurality of spaces 24, 26 inscribed in the form of at least a partial piano keyboard, shown generally as 28, covering four octaves, i.e. one octave for each of four possible players. The spaces 24, 26 are inscribed in a substantially circular form consisting of white key spaces 24 and black key spaces 26, which correspond respectively to white keys and black keys on a real piano keyboard.

Thus, as on a real piano keyboard, the note, i.e. tone or pitch, represented by each white key 24 space represents a chromatic musical distance of one semi-tone from any black key space 26, and vice-versa, abuttingly adjacent thereto. A distance of a semi-tone also separates any two abuttingly adjacent white key spaces 24 which do not have a black key space 26 inscribed therebetween. It should be noted that while white key spaces 24 and black key spaces 26 represent respectively represent white keys and black keys on a piano, white key spaces 24 and black key spaces 26 may be depicted on game board 22 in colors other than white and black.

Figure 2:
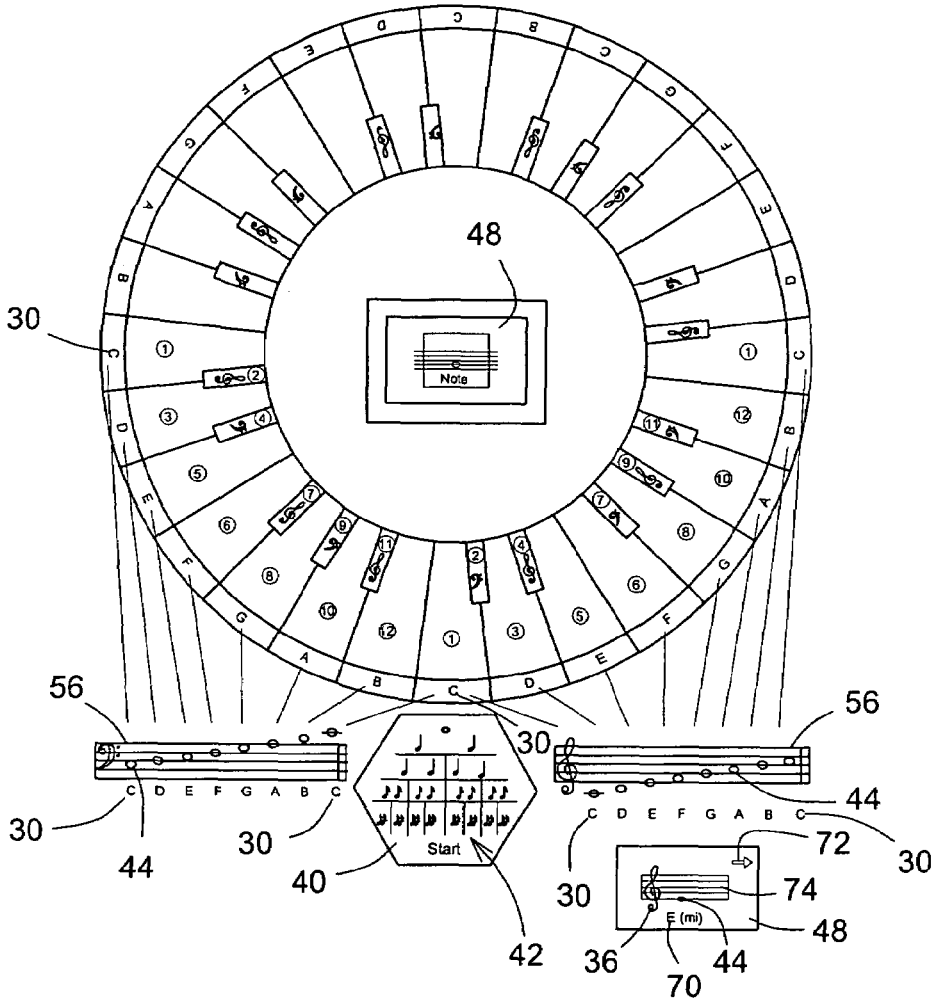
FIG. 2 is a partially broken top plan view of both bass and treble clefs and their note symbols in relation to a position of a note represented by each note symbol on a piano keyboard inscribed on the game board surface; and does not appear as depicted on the playing board but is merely a reference chart to be found in the instruction manual to indicate how moves are to be made on the game board.
Figure 3:
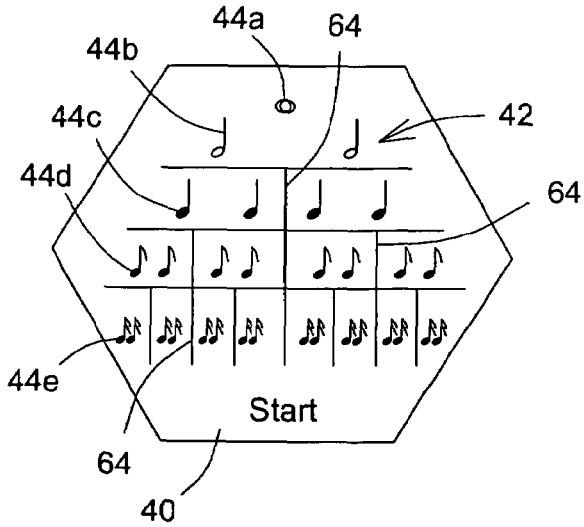
FIG. 3 is a top plan view of a hexagon, namely the starting position for each player, from the game board shown in FIG. 1, the hexagon containing a player set of note symbols.

Reference is now made to FIGS. 1, 2, and 3. Each white key space 24 is inscribed with a note name 30 which represents the actual note, i.e. tone or pitch, played when the corresponding key on a real piano keyboard is played. Further, each white key space 24 also has instructions 32 for an associated action inscribed thereon and which is to be performed by an active player who places a respective token 34 thereon during the active player's turn. Black key spaces 26 are represented on the keyboard 28 in the same position they are found in on a real keyboard with at least two of them being alternately inscribed with either a treble clef 36 or bass clef 38. Four hexagonal player start positions 40, one for each player, are situated on the game board 22 directly beneath each white key space 24 having the note name 30 of C inscribed thereupon. Each hexagonal 40 is inscribed with a respective player set, shown generally as 42, of various musical symbols 44. As shown, in FIG. 1, the musical symbols for the embodiment shown are rhythm symbols, consisting of note symbols 44, each of which may be sounded for a specific duration relative to a beat of a measure of music. Thus, the note symbols 44 in player set 42 express rhythm, as opposed to tone or pitch, hence their identification as both rhythm symbols and note symbols for the purposes of this description. Each player set 42 has the following note symbols 44: one whole note symbol 44*a*, two half note symbols 44*b*, four quarter note symbols 44*c*, eight eighth note symbols 44*d* and sixteen sixteenth note symbols 44*e*. The player set 42 allows each individual player, not shown, to keep track of each individual player's progress while playing game 20, as game 20 may be terminated when one player marks all note symbols 44 in the player's respective player set 42. It should be noted that the player start positions 40 could be situated beneath other white key spaces 24 having note names other than C for different embodiments of the present invention.

Four card containment surfaces 46 are located directly beneath the white key spaces 24 having note names 30 F and G on the game board 22 outside the perimeter of the keyboard 28 for the placement of four different sets, i.e. pluralities, of cards, namely note cards 48, question cards 50, train cards 52, and score cards 54, shown respectively in FIGS. 6, 7, 8, and 9. Train cards 52 and score cards 54 allow a player to mark a designated musical symbol shown on the card in the players respective player set 42 when the user completes a task defined on the card 52, 54 that requires knowledge of musical concepts. For the embodiment shown, the designated musical symbol also represents a duration relative to a beat of a measure of music and corresponds to the duration of time relative to a beat of music of at least one of the note symbols 44 in player set 42. Thus, for the embodiment shown, the designated musical symbols on the train cards 52 are also rhythm symbols. Note cards 48 and question cards 50 are generally used for directing placement by an active player during each active player's turn of the active player's respective token 34 on the game board 22. On the extreme edges of the game board 22 are pictured a plurality of different musical Instruments 60 with their respective clef symbol, i.e. treble clef 36 or bass clef 38, inscribed in proximity thereto. Further, for five of the instruments 60, there is a "return sign" symbol 62 inscribed in proximity thereto.

FIG. 2 is a detailed depiction of the keyboard 28 and game board musical staffs 56 inscribed on the game board 22 indicating the specific position on the white key spaces 24 of keyboard 28 that correspond to note symbols 44 inscribed on the game board musical staffs 56. Specifically, inscribed between the hexagonal player start positions 40 on the game board 22 are game board musical staffs 56 of both the bass clef 38 and treble clef 36 having imprinted on them octaves of musical note symbols 44 and corresponding note names 30 which correspond to the white key spaces 24 of keyboard 28 having the same note name 30. Advantageously, the game board musical staffs 56 also demonstrate the correct position thereon for each note symbol 44 corresponding to a given note name 30. This facilitates learning by players of the correct position of note symbols 44 on any musical staff, as well as on keyboard 28. The numbered dots indicate the sequence of movement of a player's token 34 throughout the course of play of game 20. This diagram does not appear as depicted on the game board 22, in that the numbered dots are absent on game board 22, but is to be found in the instruction manual, not shown, as reference material.

FIG. 3 is a detailed depiction of the hexagonal player start position 40. The vertical bars 64 represent an equivalency scale in regard to each note symbol 44 or series of note symbols 44. Specifically, each note symbol 44 in the player set 42 has a duration relative to a beat of a measure of music that is equal to the sum of the duration of two note symbols 44 situated adjacently therebelow, with each set of two note symbols 44 situated adjacently therebelow being separated from each other set by a vertical bar 64. For example, as is well known in the art, a whole note symbol 44*a* is equal to two combined half note symbols 44*b*. Similarly, each half note symbol 44*b* is equal in duration to two quarter notes symbols 44*c*. Each quarter note symbol 44*c* is equivalent to two combined eighth note symbols 44*d* and each eighth note symbol 44*d* is equal to two sixteenth note symbols 44*e*.

Figure 4:
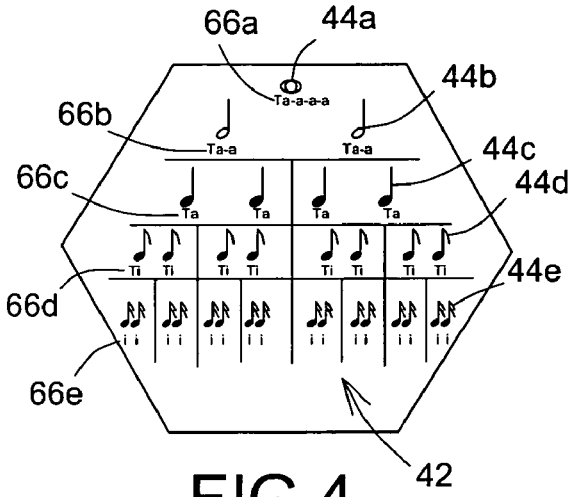
FIG. 4 is a depiction of FIG. 3 indicating vocal syllables representing each note symbol; and also does not appear as depicted on the game board but appears in the manual as further reference material.

FIG. 4 is a depiction of FIG. 3 showing associated syllables 66 which are pronounced during the duration of note symbol 44 associated therewith to indicate the identity and duration thereof. For example, a whole note symbol 44*a* would be sounded, i.e. pronounced, by a single "ta-a-a-a" syllable 66*a* representing a total of four beats, usually with "ta" being pronounced on the first beat and a slight vocal emphasis in volume accorded on each beat thereafter for the "a-a-a" part of the "t-a-a-a" syllable 66*a*. A half note symbol 44*b* would be sounded by a single "ta-a" syllable 66*b*. Again, "ta" is typically pronounced on the first beat and a slight vocal emphasis in volume is accorded on the next beat for the "-a" part of the "t-a" syllable 66*b*. This association of syllables 66 with note symbols 44 also applies to all other note symbols 44*c*, 44*d*, 44*e*, using associated syllables 66*c*, 66*d*, 66*e* pronounced with increased frequency. The diagram shown in FIG. 4 is informational and only appears in the instruction manual for the game 20 to assist players in performing score cards 54 and in filling out composition sheets 88, as explained below. Further, it should be noted that the associations between syllables 66 and note symbols 44 shown are above all intended for use with measures having a 2/4, 3/4, and 4/4 time signature. Other time signatures may also be used for the game and other syllables, not shown, may be associated with the note symbols 44 to indicate their relationship to beats of music with respect to such other time signatures.

Figure 5:
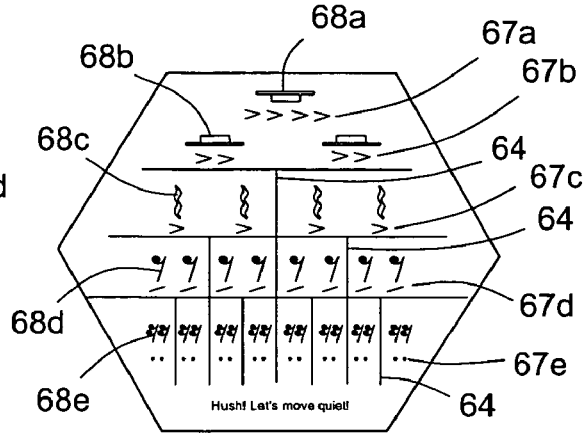
FIG. 5 is a depiction in top plan view of the rest symbols equivalent in duration to note symbols shown in FIGS. 3 and 4; and, like FIG. 4, also only appears in the instruction manual as reference material.

The equivalency scale shown for FIG. 4 also applies to musical symbols known as rest symbols 68, shown in FIG. 5, which are also rhythmic symbols representing a duration relative to beat of a measure of music. However, rest symbols 68 indicate silence or a lack of musical sound for the duration of the rest symbol 68. As is well know in the art, whole rest symbols 68*a*, half rest symbols 68*b*, quarter rest symbols 68*c*, eighth rest symbols 68*d*, and sixteenth rest symbols 68*e* have associated durations equal, respectively, to whole note symbols 44*a*, half note symbols 44*b*, quarter note symbols 44*c*, eighth note symbols 44*d*, and sixteenth note symbols 44*e*. Generally, a player remains orally silent for the duration of a rest symbol 68, as indicated by rhythm duration symbols 67*a, b, c, d, e*, when performing the rest symbol 68. However, if desired, the player may also generate percussive sounds, corresponding to rhythm duration symbols 67*a, b, c, d, e* to show duration of the rest symbols 68. The diagram shown in FIG. 5 is informational and only appears in the instruction manual for the game 10.

Figure 6:
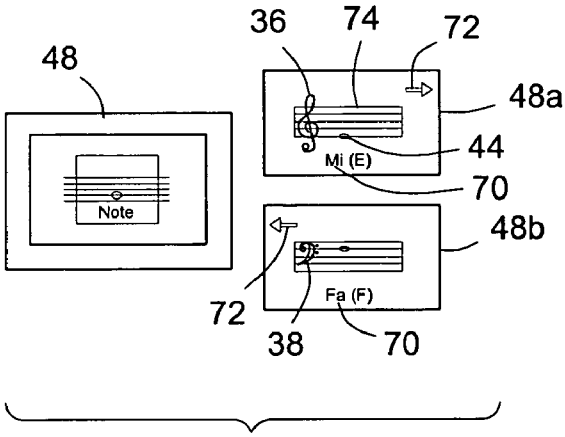
FIGS. 6, 7, 8 and 9 are typical depictions of cards, respectively note cards, question cards, trains cards, and score cards, for the game shown in FIG. 1 that are instructional in nature and pertinent to the progress of the game.

Reference is now made to FIGS. 2 and 6. FIG. 6 is a top and bottom plan view of two note cards 48, wherein the bottom plan depicts a note card note name 70 designating a corresponding designated space 24, having a note name 30 identical to note card note name 70, where an active player's token 34 must be placed when the active player selects the note card 48 during the active player's turn. The arrow 72 appearing on the right hand side of the note card 48 indicates the direction in which the active player's token 34 must be moved relative to the white key space 24, namely the white key space 24 having the note name 30 of C for the embodiment shown, situated adjacently above the active player's respective player start position 40 in which the active player's respective player set 42 is inscribed. For example, as shown for note card 48*a*, when arrow 72 points to the right, the active player moves the active player's token 34 to the right of the white key space 24 situated adjacently above the active player's respective player start position 40 where respective player set 42 is situated, and having the note name 30 of C for the embodiment shown, to the nearest white key space 24 having note name 30 identical to note card note name 70. For the purposes of this description, the white key space 24 situated adjacently above the active player's respective player start position 40 and having the note name 30 of C is also referred to as central white key space 24. As shown for note card 48*b*, when arrow 72 points to the left, the active player moves the active player's token 34 to the left of the central white key space 30 to the nearest white key space 24 having note name 30 identical to note card note name 70. Further, as shown for note card 48*a*, arrow 72 points to the right when note card staff 74 has treble clef 36, thus showing that movement of token 34 is to the right of the central white key space 24. Conversely, as shown for note card 48*b*, arrow 72 points to the left when note card staff 74 has bass clef 38, thus showing that movement of token 34 is to left of the central white key space 24. As will be noted, the note card 48 also has a note card note symbol 44 inscribed in a note card staff 74, having either a treble clef 36 or base clef 38, inscribed thereon and which represents the proper placement of the note card note symbol 44 on the note card staff 74 to designate the note, i.e. pitch or tone, associated with the note card note name 70. This position of the note symbol 44 on note card staff 74 for the note card note name 70 is identical to that shown for the position of note symbol 44 on game board staff 56 for a note name 30 that is identical to note card note name 70. Thus, to ensure that the active player in places the token 34 correctly, the active player may refer to FIG. 2, which demonstrates the correspondence between note names 30, and note card note names 70, and their respective positions on game board staffs 56 and note card staffs 74, as well as the corresponding positions of white and black key spaces 24, 26. It should be noted that designated space indicated on note card 48 could also be a black key space 26. In such a case, note card note name 70 and note card note symbol 44 could be modified to represent the note, i.e. pitch or tone, corresponding to a black key space 26, possibly by use of musical accidental symbols, i.e. sharp or flat symbols, not shown.

Figure 7:
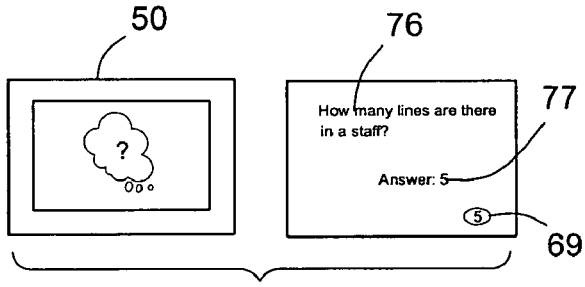

FIG. 7 is a top and bottom plan of a typical question card 50 wherein the bottom plan depicts a question 76 relating to musical concepts, an answer 77 to the question 76 and a movement indicator 69, i.e. a number. The number 69 indicates the number of consecutive adjacent spaces 24, 26, i.e. semi-tones, the active player, i.e. the player who selects the question card 50 during his turn, may move the active player's token 34 to the right of the active player's current position on keyboard 28 portion of game board 22. However prior to moving the token 34, the active player must answer the question 76 correctly. Typically when an active player must select a question card 50, another player actually draws the card, poses the question 76 to the active player, and verifies the answer 77.

Figure 8:
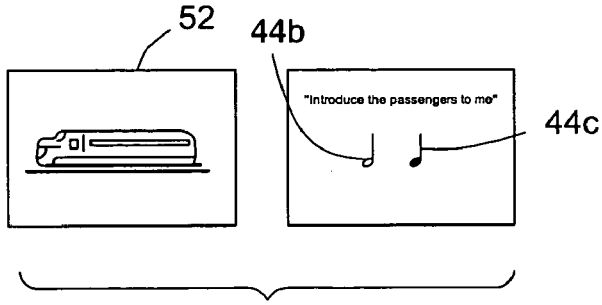

FIG. 8 is a top and bottom plan of a train card 52 wherein the bottom plan depicts at least one train card rhythm symbol, i.e. a train card note symbol 44 and/or a train rest symbol 68. At least one of these rhythm symbols 44, 68 is identified, by using a different color compared to the rest of the train card rhythm symbols 44, 68 or by highlighting, as a designated rhythm symbol 44, 68 which is the designated musical symbol for the card 52. The task defined by the train card 50 requires the active player who draws the train card 50 to identify all of the train card rhythm symbols 44, 68 shown on the train card 52 by presenting their rhythm names, i.e. the names of the symbols 44, 68, to the other players. The active player may then, for each designated rhythm symbol 44, 68 shown, mark one or more note symbols 44 in the active player's player set that are equivalent, as previously explained with regard to FIGS. 3, 4 and 5, in duration to the designated rhythm symbols 44, 68.

Figure 9:
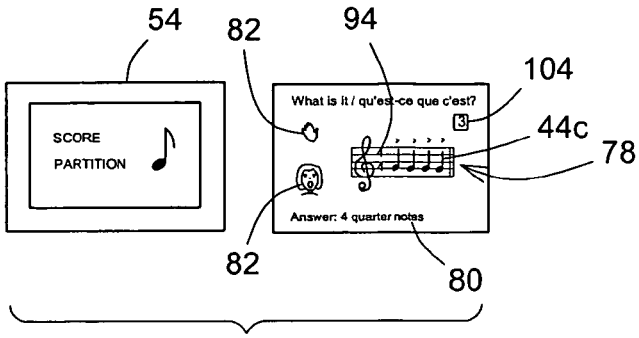

FIG. 9 is a top and bottom plan of a typical Score/Partition Card 54 wherein the bottom plan has at least one score partition card measure, shown generally as 78, of music. Each score card measure 78 has at least one musical symbol, in the form of a score card rhythm symbol such as a score card note symbol 44 and score card rest symbol 68, inscribed therein. At least one of the score card rhythm symbols 44, 68 is identified as a designated rhythm symbol 44, 68, i.e. a designated musical symbol as explained above for train cards 52 with regard to FIG. 8, for marking in the player set 42. When the active player, i.e. the player currently executing her or his turn, draws a score card 54, the active player must, to complete the task defined by the card 54, perform each of the score card note symbols 44 and score card rest symbols 68 in each of the score card measures 78 shown on score card 54. Specifically, the active player pronounces the associated syllables 66 associated with the score card note symbols 44, each for their respective duration, while generating a percussive sound for each beat of the score card measure 78. For the score card rest symbols 68, the active player remains orally silent but continues to generate the percussive sound for each beat. The percussive sound can be generated in a number of ways, including clapping hands, tapping feet and/or hands on a surface, or snapping fingers. If the active player correctly performs the measure 78, the active player marks, for each designated rhythm symbol 44, 68 on card 54, one or more note symbols 44 in the active player's player set 42 that are equivalent in duration, as previously explained with regard to FIGS. 3, 4, and 5, to the designated rhythm symbol 44, 68. At the same time, for other players, i.e. listening players, the task consists of identifying the rhythm name, in the order of performance, of each score card rhythm symbol 44, 68 performed by the active player. Each listening player who successfully does so is also entitled to mark the designated rhythm symbol or its equivalent, as explained for FIGS. 3, 4, and 5, in the listening player's player set 42. The solution 80, i.e. the correct identification of rhythm names for the score card rhythm symbols 44, 68, is also set out on the score card 54. Hand and head icons 82 assist the player by indicating that the task requires performing of the score card measure 78.

Figure 10:
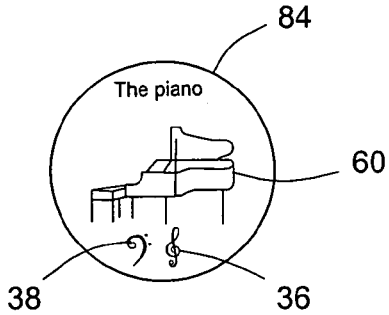
FIG. 10 is a depiction in top plan view of a typical instrument oval apparent on the game board of the game shown in FIG. 1.

FIG. 10 is a top plan view of a typical instrument oval 84, one of twenty on the game board 22 for the embodiment shown. In each oval 84, an instrument 60 is depicted. The instrument's 60 clef signature, i.e. treble clef 36 or bass clef 38, is inscribed in proximity to, i.e. below, each instrument 60 in the oval 84. Further, five of the instruments, i.e. trumpet, alto clarinet, trombone, flute and woman/child voice, also have an additional return sign symbol 62 inscribed proximal thereto in the oval 84. An instrument 60, not previously marked by another player, is marked by the active player when the active player places token 34 on black key space 26 having a treble clef 36 or bass clef 38 inscribed thereon, in which case active player marks an instrument 60 having the same clef 36, 38 as the black key space 26 on which the token 34 is situated. Alternatively, should active player place token 34 on white keyboard space 24 having a return sign symbol 62 inscribed thereon as instruction 32 for associated action, active player may mark any instrument 60 having return sign symbol 62 inscribed in oval 84 proximal thereto that has not already been marked.

Having described the board 22 and function of cards 48, 50, 52, 54 the procedure for playing the game is now described. The game may be played by two to four players. Each player is provided with a marker 86 and a token 34 the latter being initially placed by the players on their designated Hexagonal Start Positions 40. To determine the order of play, each player selects a note card 48 from the designated card containment space 46. The player who draws the note card 48 having the highest note in the treble clef 36, as shown by the note card note name 70 and note card note symbol 44 on the note card staff 74 begins first, i.e. takes the first turn. Once the player who takes the first turn has been so identified and takes her or his turn, other players execute their turns, proceeding from left to right. For the purposes of this description, a player is referred to as the active player while the player is executing the player's turn. After the order of play is determined, note cards 48 are replaced in the note card deck that is shuffled and play begins. The active player draws a note card 48 and moves the player's token 34 to the designated space 24 indicated by the note card note name 70 and note card note symbol 44 on the note card 48, as explained above with regard to FIG. 6. As the designated space 24 of note card indicates a white key space 24, having instructions 32 for an associated action inscribed thereupon, the active player carries out the associated action indicated by instructions 32, which can consist of selecting another card 48, 50, 52, 54 and completing the tasks/action defined thereon, as respectively described with regard to FIGS. 6, 7, 8, and 9. The instructions 32 may also specify associated action as moving the token 34 to a new space 24, 26 designated on the white key space 24 or, if the white key space 24 has a return sign symbol 62, coloring an instrument having the return sign symbol 62, as described for FIG. 10. As the active player completes the associated actions, the active player will move the active players token along both white and black keys spaces 24, 26. In the course of the "turn", the active player will, provided he selects a train card 52 or score card 54, use marker 86 to mark designated rhythm symbols, i.e. note symbols 44 for the embodiment shown, or their equivalents in duration, as explained for FIGS. 3, 4, 5, 8 and 9, in the active player's player set 42. Other players other than active player may also mark rhythm symbols, i.e. note symbols 44, in their respective player sets 42 using marker 86 when they correctly identify each rhythm symbol 44, 68 performed by the active player when the active player selects a score card 54, as explained above with regard to FIG. 9. Subsequent players proceed in a like manner, as active players, until the game 20 terminates and there is a winner. In general, the game 20 terminates when a player checks off all note symbols 44 in the player's respective player set 42, the first player to do so being designated the winner of the game 20.

A player's progress in the game is generally facilitated when he places his token on a black key space 26. When a player, i.e. active player, places his token 34 on a black key space 26, he marks, with the marker 86, an instrument 60 of his choice which shares the same clef signature, i.e. treble clef 36 or bass clef 38, inscribed in proximity to the instrument 36 as that inscribed on the black key space 26, as explained previously with regard to FIG. 10. Another opportunity to mark an instrument 60 arises when active player places token 34 on a white key space 24 having the return sign symbol 62 inscribed thereon, also as previously explained with regard to FIG. 10. Once a player has marked a pre-determined quantity, say four, of instruments 60, player is designated as a "conductor," which enhances the player's ability to mark symbols, i.e. note symbols 44, in his player set 42 through the play of his opponents. Specifically, a conductor is allowed to mark each designated rhythm symbol 44, 68, or its equivalent as explained with regard to FIGS. 3, 4, and 5, in his respective player set 42 for each train card 52 selected by any other player. In addition, a conductor is allowed to mark each designated rhythm symbol 44, 68, or its equivalent as explained with regard to FIGS. 3, 4, and 5, for any score card selected by any other player without having to identify the rhythm symbols 44, 68 performed. Thus, a conductor is provided with many more opportunities to mark conductor's player set 42, as compared to the other players who are not conductors.

Figure 11:
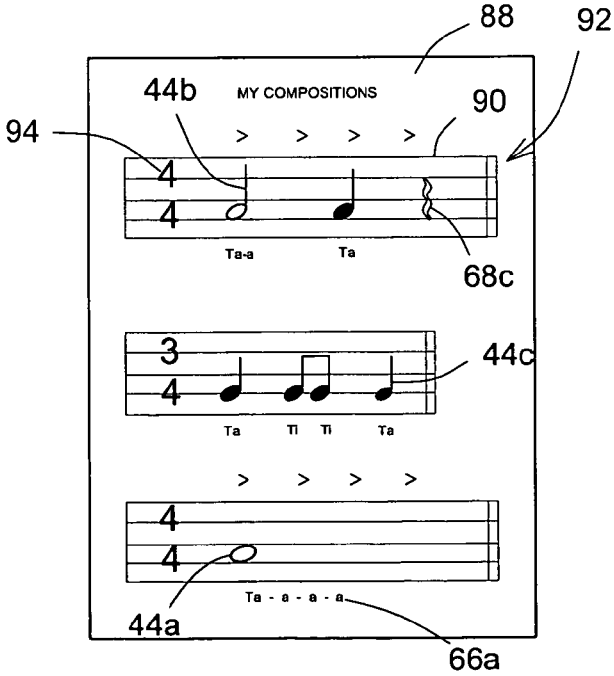
FIG. 11 is a depiction of a composition sheet for use in an advanced version of the game shown in FIG. 1.

Referring now to FIGS. 8 and 11, optionally, for an advanced version of game 20, players who are not conductors are designated as composers. Each composer receives a sheet of paper 88 having a composer musical staff 90 inscribed thereupon. When an active player who is a composer selects a train card 52, the active player identifies the train card rhythm symbols 44, 68 inscribed thereon and marks the equivalent symbols 44 in the respective player set 42, as explained previously. The conductor also marks the conductor's respective player set 42 as described above. However, the composer must also inscribe each train card rhythm symbol 44, 68 on the train card within a composer measure 92 inscribed by the composer in the composer staff on the sheet 88 provided. Further, the composer must also mark the associated syllables 66 and rhythm duration symbols 67 for each rhythm symbol 44, 68. Each composer must completely mark the composer's respective player set 42 as well as inscribe a predetermined number of composer measures 92, before the conductor conducts the composer players and completely marks all symbols 44 in conductor's respective player set 42, in order to win the game 20. Otherwise, the conductor is the winner. Each composer must complete 1, 2 or 3 composer measures 92, depending on whether there are, respectively, 2, 3, or 4 players.

Referring now to FIGS. 8, 9 and 11, with regard to score cards 54 for the advanced version of the game 20, the conductor takes all of the score cards 54 and chooses a plurality thereof having a desired same time signature 94 inscribed in the score card measure 78, such as: 2/4, 3/4, 4/4, 6/8, 9/8, 12/8 or the like. The desired time signature 94 used as the basis for sorting the score cards 54 is selected by the conductor. When the active player is a composer who must select a score card 54, the composer selects the score card 54 from the plurality of score cards 54 having the desired time signature 94 chosen by the conductor. Alternatively, the conductor may choose the score card 54, having the desired time signature 94, that is received by the composer. The composer who selects the score card, i.e. the active player, then performs the score card measure 78 and the players, whether conductors or composers, mark their respective player sets 42, as described previously. After the performance, the composer who selected the score card 54 keeps the score card selected unless the composer is obliged to select another score card by placing his respective token 34 on a white key space 24 requiring her/him to do so. As soon as two or more composers have score cards 54, and after the composer who drew the last score card 54 has performed the score card measure 78, the conductor asks the composers having the score cards 54 to perform the score card measures 78 inscribed thereupon together, i.e. to complete an additional performance thereof together. The conductor conducts the composers while they perform the score card measures 78 during the additional performance. The conductor conducts the composers either by generating a percussive sound for each beat or by using a conducting pattern associated with the desired time signature 94. It should be noted that there can only be one conductor at a time, at least for the advanced version of the game 20. Accordingly, when a new player, previously a composer, becomes a conductor by marking four instruments 60, the previous conductor becomes a composer. The new conductor keeps and continues to use the score cards 54 having the desired time signature 94 selected by the previous conductor. The (current) conductor wins the game when he has completely marked his player set 42, i.e. all symbols 44 thereof, and has conducted the composers having score cards 54 at least once before any composer has completely marked her/his respective player set 42 and inscribed the required number of composer measures 92. Otherwise, the first composer player to have completely marked her/his respective player set 42 and inscribed the required number of composer measures 92 is the winner.

Figure 12:
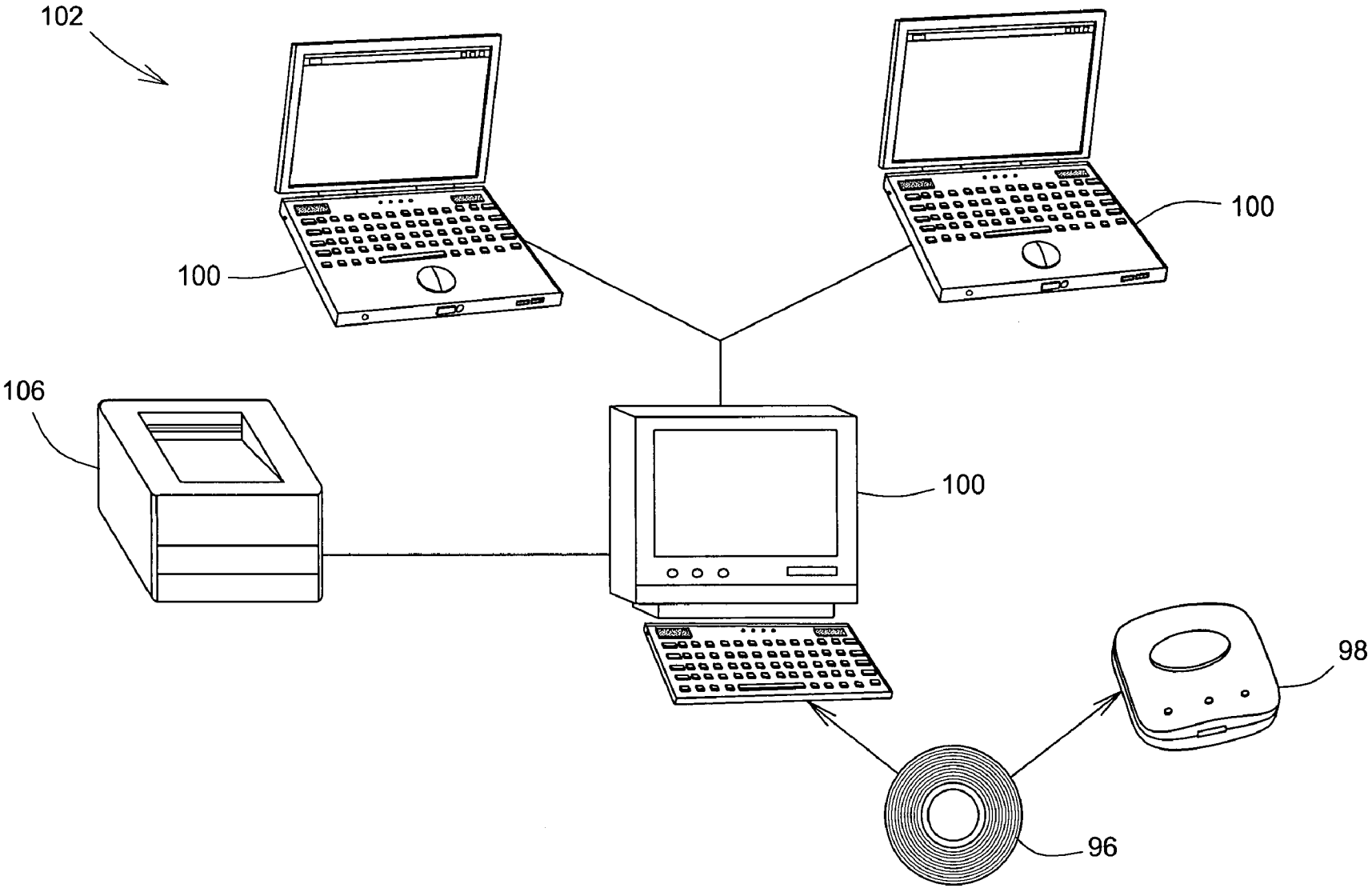
FIG. 12 is a block diagram of a computing device and network used in association with the game shown in FIG. 1.

Reference is now made to FIGS. 9 and 12. If desired, players can verify the performance of the active player by consulting a recorded version of the score card measure 78, in which the score card measure 78 is performed. The recorded version may be stored on a compact disk 96, which may be accessed using an audio device, such as compact disk player device 98, or by using a computing device 100 having a CD-ROM. In addition, the recorded version may be otherwise stored on the computing device 100, such as, for example, on a disk drive or in random access memory, flash memory, read only memory. Further, the recorded version can also be accessed by using computing device 100 via a network, shown generally as 102, to connect to another computing device 100 which can access the recorded version. A boxed number 104 inscribed on the score card 54 indicates a performance correction indicator 104 which indicates a location, such as a track on compact disk 96, an index for a hard drive or database, or a network address, where the recorded version for a particular score card measure 78 is located.

The computing device 100 may be, among other things, a personal computer, a portable computer, a personal digital assistant, or any other device having a processor that is capable of accessing and playing the recorded version. The network 102 may be any kind of network suitable for transmission of data between computing devices 100, including the Internet. Further, users may also use the computing device 100 to access additional score card measures 78 stored thereon or which are otherwise accessible on other computing devices 100 using network 102. For example, a player could visit a web site using the computing device 100 and download the additional score card measures 78. Such a web site may require a user to purchase a subscription, possibly included with game 20, and to login using information provided with the subscription to access the additional score card measures 78. The web site may also provide access to interactive musical games to reinforce musical concepts, with such access also being controlled based upon purchase of a subscription. Additional score card measures 78, regardless of how they are accessed, may be printed out on a printer 106 connected to the computing device 100 for use as score cards 54 while playing game 20. The web site and games may consist of Hyper Text Markup Language (HTML), Extensible Markup Language (XML), JAVA, Macromedia Flash code and/or script, javascript, and combinations thereof, as well as any other computer programming language, scripting language, or protocol adaptable for displaying web pages, providing multi-media applications on web pages, and for providing validated secure access to content on web pages.

It should be noted that the player tokens 34 may be any object suitable for placement on keyboard spaces and may be made of any material, including paper, rubber metal, plastic, or the like. However, the material from which player tokens 34 are made will preferably be non-toxic. Similarly, there may be one marker 86 for each player, perhaps each marker 86 having a different color. Markers 86 may be any marking device capable of marking on game board 22 and on paper for composer measures 92, such as ink markers, wax crayons, washable wax crayons, pens, pencils, felt markers, or the like. However, preferably, the game board 22 will have an erasably markable surface upon which players may make marks with marker 86 and which can be subsequently erased. For example, markers 86 may be washable wax crayons and the game board 22 may have a plastic laminate surface upon which players may make marks and which can be subsequently erased by wiping the laminate surface with, among other things, a towel or cloth.

Based on the above description, it is apparent that the present invention offers a pastime, i.e. the game 20, which is entertaining, challenging and educational and with which players can be taught both basic and, to some degree, advanced concepts of music. In particular, the game teaches concepts relating to reading and performing musical rhythms, i.e. rhythm symbols 44, 68, and understanding the relationship between the note symbols 44 on a musical staff 74, 90 and the keys on a real keyboard. Additionally, some knowledge of instruments 60 will be gleaned. The extended version would further expand the musical concepts by introducing elements of conducting and composition thus adding more enjoyment and knowledge to the learning process.

While a specific embodiment has been described, those skilled in the art will recognize many alterations that could be made within the spirit of the invention, which is defined solely according to the following claims. The description herein is provided for purposes of illustration and not limitation.

I claim:

1. A game for learning musical concepts, said game comprising:

a plurality of tokens for use by a plurality of players for playing said game, each said player having a respective said token;

a game board upon which the game is played by said players, said game board having a plurality of spaces inscribed thereupon as white key spaces and black key spaces upon which said tokens can be displaced to indicate respective current positions on said game board for said players, and, for each said player, a respective player set of musical symbols inscribed thereupon, said white key spaces and said black key spaces corresponding, respectively, to respective white keys and respective black keys of a piano keyboard with each said white key space having a note name inscribed thereon designating a note associated with said respective said white key on said piano keyboard, said respective said token being displaced by an active player of said players executing a respective turn therefore;

a first plurality of cards, each said card thereof defining a task requiring knowledge of the musical concepts for completion by at least one said player and indicating a designated musical symbol corresponding to at least one said musical symbol of said respective player set; and at least one marker for marking, by said at least one said player, of said designated musical symbol of said respective player set on said game board when said at least one said player successfully completes said task.

2. The game of claim 1, wherein said game board comprises an erasably markable surface upon which said players may erasably mark said musical symbols of said respective player sets.

3. The game of claim 1, wherein said marker is a wax crayon.

4. The game of claim 1, wherein said game terminates when one said player marks all said musical symbols of said respective player set, said one said player thereby being designated a winner of said game.

5. The game of claim 1, wherein said white key spaces and said black key spaces are arranged to form a substantially circular shape on said game board representing a plurality of octaves of said keyboard.

6. The game of claim 5, wherein said circular shape comprises at least one said octave for each said player.

7. The game of claim 1, wherein each said musical symbol and said designated musical symbol is a rhythm symbol, each said rhythm symbol having a respective rhythm name associated therewith and representing a respective duration relative to a beat of a measure of music.

8. The game of claim 7, wherein said first plurality of cards comprises a score set of score cards, each said score card having at least one respective said measure inscribed thereon as a respective score card measure, each said respective score card measure having at least one said rhythm symbol inscribed therein as a score card rhythm symbol and said task comprising performance of each said respective score card measure by said active player when said active player selects said score card during said respective turn.

9. The game of claim 8, further comprising a recorded version of each said score card measure, in which said score card measure is performed, and which is accessible from at least one of a computing device and an audio device for verifying correctness of said performance by said active player.

10. The game of claim 8, further comprising additional said score card measures stored on a computing device and which may be printed using a printer connected to said computing device to provide additional said score cards.

11. The game of claim 7, wherein said respective duration of at least one said rhythm symbol in each said respective player set is equivalent to a sum of said respective durations of at least two combined said rhythm symbols of said respective player set.

12. The game of claim 11, wherein said at least one player may mark said combined rhythm symbols in said respective player set when said sum thereof is equivalent to said designated rhythm symbol.

13. The game of claim 7, wherein said first plurality of cards comprises a train card set of train cards, each said train card having at least one said rhythm symbol inscribed thereupon as a train card rhythm symbol, said task comprising presentation of each said train card rhythm symbol and said respective rhythm name therefore by said active player when said active player selects said train card during said respective turn.

14. The game of claim 13, wherein said first plurality of cards comprises a score set of score cards, each said score card having at least one respective said measure inscribed thereon as a respective score card measure, each said respective score card measure having at least one rhythm symbol inscribed therein as a score card rhythm symbol and said task comprising performance of each said respective score card measure by said active player when said active player selects said score card during said respective turn.

15. The game of claim 14, wherein said at least one score card rhythm symbol comprises at least one of a score card note symbol and a score card rest symbol, said performance comprising oral pronunciation by said active player of a syllable associated with each said score card note symbol during said respective duration thereof and oral silence by said active player during each said score card rest symbol for said respective duration thereof, said active player generating a percussive beat sound for each said beat of said score card measure.

16. The game of claim 15, wherein said task further comprises identification by at least one listening player, other than said active player, of said respective rhythm name for each said score card rhythm symbol of said respective score card measure based on said performance, said listening player subsequently marking said designated musical symbol on said respective player set when said listening player correctly identifies each said respective rhythm name.

17. The game of claim 14, further comprising a second plurality of cards, each said card thereof being a note card, each said note card indicating a designated space upon said game board upon which said active player is to place said respective token when said note card is selected by said active player during said respective turn.

18. The game of claim 17, wherein each said note card has a note card musical staff inscribed thereupon and a note card note symbol inscribed upon said note card musical staff, said note card note symbol designating a designated note represented on said game board by one of a corresponding said white key space and a corresponding said black key space which corresponds to said designated note as said designated space.

19. The game of claim 18, wherein said note card musical staff has one of a treble clef and an bass clef inscribed thereupon, said treble clef indicating that said designated space is said corresponding said white key space or said corresponding said black key space situated most closely to the right of a central said white key space, said bass clef indicating that designated space is said corresponding said white key space or said corresponding said black key space that is situated most closely to the left of said central said white key space, said central said white key space being situated adjacently above said respective player set and corresponding to a said white key of said keyboard corresponding to a note of C.

20. The game of claim 17, wherein each said white key space has instructions inscribed thereupon for an associated action to be completed by said active player when said active player places said respective token thereupon during said respective turn.

21. The game of claim 20, further comprising a third plurality of cards, each said card thereof being a question card defining a question requiring knowledge of the musical concepts and a number indicating a quantity of said spaces by which said active player drawing said question card may move said respective token after providing a correct answer to said question.

22. The game of claim 21, wherein said associated action comprises one of drawing a said note card, drawing a said train card, drawing a said score card, drawing a said question card, and moving a pre-determined number of said spaces in a pre-determined direction.

23. The game of claim 17, wherein said game board further has a plurality of instruments inscribed thereupon, each said instrument having one of a treble clef and a bass clef inscribed in proximity thereto, said treble clef and said bass clef being further inscribed marked on a separate said black key space, said active player marking one said instrument having said treble clef inscribed in proximity thereto with said marker when said respective token of said active player is placed on said black key space having said treble clef inscribed thereon and marking one said instrument having said bass clef inscribed in proximity thereto when said respective token is placed on said black key space having said bass clef inscribed thereon.

24. The game of claim 23, wherein a said player is designated as conductor after marking a pre-determined number of said instruments.

25. The game of claim 24, wherein said conductor conducts said active player during an additional performance of said score card measure in conjunction with at least one additional player who simultaneously performs another said score card measure.

26. The game of claim 25, wherein said conductor further marks said rhythm symbols in said respective player set for every said score card and every said train card drawn by every other said player.

27. The game of claim 26, wherein said game terminates when one said player marks all said musical symbols of said respective player set, said one said player thereby being designated a winner of said game.

28. The game of claim 26, wherein each additional said player, other than said conductor, is designated as a composer when said conductor is designated.

29. The game of claim 28, further comprising, for each said composer, a respective composition sheet of paper having at least one composer staff inscribed thereon for inscription by said composer, when said composer is said active player and selects a train card, of a composer measure upon said composer staff, said composer measure containing all said train card rhythm symbols inscribed on said train card.

30. The game of claim 29, wherein said conductor Is re-designated as a said composer when another said composer completes said marking of said pre-determined number of said instruments subsequently to said conductor, said another said composer being re-designated as said conductor.

31. The game of claim 30, wherein said game terminates and said conductor is designated a winner of said game when said conductor marks all said respective said rhythm symbols of said respective player set and has conducted at least one said additional performance before a first said composer inscribes a pre-determined number of said composer measures upon said respective composer sheet and marks all said rhythm symbols of said respective player set of said first said composer, said first said composer otherwise being designated said winner.

* * * * *